US007319403B2

(12) United States Patent
Woodard et al.

(10) Patent No.: US 7,319,403 B2
(45) Date of Patent: Jan. 15, 2008

(54) COMBINATION CARBON MONOXIDE AND WIRELESS E-911 LOCATION ALARM

(76) Inventors: Noel Woodard, P.O. Box 19646, Seattle, WA (US) 98109-6646; Jon Woodard, P.O. Box 19646, Seattle, WA (US) 98109-6646

( * ) Notice: Subject to any disclaimer, the term of this patent is extended or adjusted under 35 U.S.C. 154(b) by 159 days.

(21) Appl. No.: 11/071,636

(22) Filed: Mar. 2, 2005

(65) Prior Publication Data

US 2005/0200492 A1 Sep. 15, 2005

Related U.S. Application Data

(60) Provisional application No. 60/551,303, filed on Mar. 8, 2004.

(51) Int. Cl.
*G08B 17/10* (2006.01)

(52) U.S. Cl. ..... 340/632; 340/539.13; 340/628

(58) Field of Classification Search ..... 340/632, 340/539.13, 539.1, 506, 628, 531, 521
See application file for complete search history.

(56) References Cited

U.S. PATENT DOCUMENTS 5,283,816 A 2/1994 Gomez Diaz
5,801,633 A 9/1998 Soni
5,889,468 A * 3/1999 Banga ..... 340/628
5,999,094 A * 12/1999 Nilssen ..... 340/507
6,127,935 A * 10/2000 Davidson et al. ..... 340/691.5
6,144,310 A * 11/2000 Morris ..... 340/692
6,288,642 B1 * 9/2001 Dohrmann ..... 340/540
6,426,703 B1 7/2002 Johnston et al.
6,484,951 B1 11/2002 Mueller
6,552,248 B1 4/2003 Andres et al.
6,661,346 B1 12/2003 Wood et al.
6,756,913 B1 * 6/2004 Ayed ..... 340/825.49
7,019,646 B1 * 3/2006 Woodard et al. ..... 340/539.26
7,098,787 B2 * 8/2006 Miller ..... 340/539.18

* cited by examiner

*Primary Examiner*—Jeffery Hofsass
*Assistant Examiner*—Hoi C. Lau

(57) ABSTRACT

The present invention provides a device and method for automatically reporting and determining the geographic location of potential carbon monoxide emergencies utilizing wireless E-911 location systems. The combination carbon monoxide and wireless E-911 location alarm in its main device embodiment comprises a self-contained carbon monoxide alarm interfaced with a cellular transceiver, which operates in existing wireless E-911 location systems. The cellular transceiver is a cellular processor with integrated memory for storing emergency identification data for automated carbon monoxide emergency incident reporting to 911 public safety answering point operators. In one mode of operation, upon sensing the presence of carbon monoxide, the cellular transceiver automatically initiates a 911 emergency call, transmitting emergency identification information over a wireless E-911 location system to a 911 public safety answering point operator, who dispatches public safety personnel to the location of the emergency carbon monoxide incident.

16 Claims, 6 Drawing Sheets

COMBINATION CARBON MONOXIDE AND WIRELESS E-911 LOCATION ALARM

CROSS REFERENCE TO RELATED APPLICATIONS

This application is entitled to the benefit of Provisional Patent Application Ser. No. 60/551,303 filed Mar. 8, 2004.

FEDERALLY SPONSORED RESEARCH

Not Applicable

SEQUENCE LISTING OR PROGRAM

Not Applicable

BACKGROUND OF THE INVENTION

1. Field of the Invention

The present invention relates generally to an alarm for sensing the presence of carbon monoxide in the environment, and automatically initiating an emergency 911 call to a 911 public safety answering point. More specifically, the present invention provides a self-contained combination carbon monoxide alarm device with an integrated cellular transceiver to automatically initiate a 911 emergency call over a wireless E-911 location system to a 911 public safety answering point.

2. Description of Related Art

Carbon monoxide poisoning, smoke inhalation, and fire is a wide-spread and ongoing threat to public safety and homeland security. Although smoke and fire are often detectable by sight and smell, carbon monoxide is known as the "silent killer," due to its tasteless, odorless, colorless, and poisonous properties. Carbon monoxide is produced by the incomplete burning of solid, liquid, and gaseous fuels. Many appliances fueled with natural gas, liquefied petroleum, oil, kerosene, coal, charcoal, or wood may produce poisonous carbon monoxide. In addition, running automobiles, recreational vehicles, and other combustion engines produce poisonous carbon monoxide. Further, while fire is known mostly for generating smoke, it can also generate poisonous carbon monoxide.

Detecting dangerous levels of carbon monoxide at the earliest stages, alerting building occupants for rapid evacuation, and notifying 911 emergency dispatch operators to summon emergency response personnel are key factors for public safety. However, delay or failure of any one of the key factors dramatically increases the dangers of carbon monoxide, smoke, and fire. Accordingly, reduced physical injury, reduced loss of life, and reduced property damaged are all dependent upon building occupants safely evacuating a building and quickly contacting a emergency dispatch operator to summon further assistance.

Devices for sensing dangerous levels carbon monoxide and initiating an alarm are presently available. Single station carbon monoxide alarms are available in single sensor units, or combined with smoke sensors in one alarm, utilizing AC and/or DC power sources.

Although the above-mentioned single station alarms provide many important features, many drawbacks exist. For instance, in larger buildings containing multiple rooms or levels, carbon monoxide or smoke may be detected in remote or unoccupied areas for unknown periods of time before the occupants are alerted, allowing the carbon monoxide to raise to life threatening levels, or allowing fire to spread. Furthermore, heavy sleeping, intoxicated, persons on medications, and high-risk (e.g., children, elderly, physically challenged, sensory-impaired) occupants may not hear or otherwise respond to the activated alarm sound before being overcome by carbon monoxide or smoke. Even carbon monoxide alarms equipped with a visual alarm or strobe may not awaken this category of occupants due to the aforementioned and other design limitations.

To alleviate the above and other shortcomings, federal, state, and local safety and fire codes may require that newer residences install multiple alarms equipped interconnection means for multiple alarm activation. Alarms are presently available that allow multiple alarms to be interconnected within a building, so when any one of the interconnected alarm senses carbon monoxide or smoke, other interconnected alarms are activated.

Despite solving some of the problems of single station carbon monoxide and smoke alarms, drawbacks exist with the above-mentioned interconnected alarms. For example, although interconnected alarms may alert building occupants to carbon monoxide or fires in remote or unoccupied areas, if the building is unoccupied or vacant, the danger often goes undetected as the carbon monoxide level increases or a fire spreads to out of control. Only in the event neighbors or other observers haphazardly notice the burning building will emergency response personnel be contacted. Partially alleviating these drawbacks, smoke alarms are presently available that incorporate a landline telephone link.

Other hard-wired or wireless interconnected carbon monoxide and smoke detectors are part of household or commercial security systems, which are primarily designed for intrusion detection and other security related applications. These systems may employ numerous components, including of a separate wall-mounted control panel, keypad, wireless receiver, and various wireless security sensors. These systems often comprise a landline telephone with auto-dialer connected to a public switched telephone network, which then automatically notifies a central station monitoring facility upon alarm activation, who then retransmits the alert to a 911 operator. Other security systems provide a separate component that contains either primary or back-up wireless transmitters for alerting a commercial central station monitoring facility. Also, most integrated security systems often use vendor specific equipment and add-on components.

Despite their advantages, shortcomings of integrated security systems containing carbon monoxide and smoke detectors are numerous. First, such systems are cost prohibitive for carbon monoxide monitoring or fire protection, due to the numerous components and sizable installation costs. Because of these costs, non-homeowners or persons with low-income or marginal credit ratings may be unable to afford installation costs and monthly service fees. Second, integrated security systems require skilled technicians to install, test, and maintain. Third, many integrated security systems may not include carbon monoxide or smoke detectors with the basic security system package. Furthermore, these systems often employ a separate landline or wireless auto-dialer component, which requires the user to subscribe to separate landline or wireless telephone service, and utilize off-site commercial central station monitoring facility, requiring additional monthly fees. Still another disadvantage is an off-site central station monitoring facility must retransmit any alarm events to a 911 operator.

A further limitation of all of the above-mentioned carbon monoxide and smoke alarms, is that they are not specifically designed for installation in building structures undergoing construction, or an effective means for carbon monoxide or fire monitoring in vacant residences or commercial buildings. In most residential and commercial buildings under construction, there is no means for carbon monoxide or fire monitoring, often no telephone service, and often no registered street address. The workers on the construction site and persons in the immediate vicinity are the primary means for monitoring potential carbon monoxide and fire dangers. Because such buildings may be vacant during the off-work hours, a build-up of dangerous levels of carbon monoxide or a fire may burn unnoticed before it rages out of control, causing danger to workers, fire damage to the said building, fire damage to adjacent properties, and increased danger to emergency response personnel.

Although security systems that include carbon monoxide and smoke detectors have the ability to automatically summon assistance through a intermediate commercial central station monitoring facility, a key drawback of such systems and existing single and multiple station carbon monoxide and smoke alarms is their lack of effective means for automatic and direct notification to a 911 operator, often referred to as a 911 public safety answering point, of the specific nature and location of the carbon monoxide or fire emergency.

In most cases, building occupants calling 911 reporting a carbon monoxide or fire emergency use either a conventional landline or cellular telephone. But oftentimes these telephones are located inside the dangerous area that the occupant is attempting to evacuate. The main drawback is that an occupant who is attempting to use a telephone is often in a heightened state of anxiety, confused, or injured, so spending time locating a telephone, dialing 911, waiting for a call connection, and verbally articulating the nature of the emergency and other detailed information to a 911 dispatcher can increase the chances of injury and waste critical evacuation and response time. Moreover, the previously mentioned intoxicated or high-risk occupants may be substantially limited in their ability to quickly locate a telephone and effectively communicate with a 911 dispatcher during a life threatening carbon monoxide or fire emergency.

Wireless telecommunications network systems, often referred to as cellular or PCS networks, along with mobile cellular telephones, are presently available. Aside from being a revolutionary innovation for mobile voice and data communications, many other uses exist, such as determining the geographic location of a mobile cellular telephone. Wireless location is important for a wide-range of applications including telematics, mapping and direction finding, and emergency services.

Most landline telephones in the United States utilizing the public switched telephone network have enhanced 911 service capabilities. Most of these landline enhanced 911 systems have the capability to provide the public safety answering points with a call back number and a physical address of the telephone when calling 911. However, with a growing number of households canceling their landline telephone service and going cellular-only, landline enhanced 911 service becomes unavailable to those households. In most cases, using a mobile cellular telephone to call 911 requires the caller to inform the emergency dispatch operator of the nature and physical location of the emergency.

Due to these issues and a dramatic increase in 911 calls originating from cellular telephones, the U.S. Congress and the Federal Communications Commission ("FCC") enacted regulatory mandates requiring wireless telecommunications carriers to upgrade and modify their cellular and PCS network infrastructures, and make appropriate upgrades to cellular telephones to provide wireless 911 service similar to landline enhanced 911 service. These combined efforts created a new wireless location system concept, called wireless enhanced 911, to pinpoint or track the location of a cellular telephone during an emergency. The FCC mandates consist of Phase I and Phase II standards that require various levels wireless location determination.

Numerous wireless enhanced 911 location system concepts are presently available. Phase I systems generally require a carrier to provide the closest cell site/sector, and Phase II network and handset based systems generally pinpoint or track the location of cellular telephones either by using upgraded cellular or PCS network infrastructure, equipping the cellular telephones with a Global Positioning System receiver. It is understood that because neither the network nor handset based wireless location concepts provide 100% accuracy, hybrid wireless enhanced 911 location system concepts exist that combine the advantages of the two concepts.

It is worth mentioning that wireless enhanced 911 location system concepts are primarily designed and utilized for determining the geographic location of voice-only cellular telephones, although many other devices or uses are possible. As previously noted above with other 911 systems, the intended use of wireless enhanced 911 location involves the user seeking emergency assistance to manually entering the "9-1-1" numeric sequence or some variation into the cellular handset keypad, thereby contacting a emergency 911 dispatch operator to report the emergency. Once a connection is made, the user verbally articulates the nature of the emergency to a emergency dispatch operator. Although mobile cellular telephones are an important tool for general safety and emergency reporting, they still require a human user to operate, and are not specially designed for carbon monoxide or fire safety.

Another issue is that in order to utilize a cellular telephone to call 911 or use wireless enhanced 911 emergency location services, a user is often required to purchase or acquire a mobile cellular telephone, and enter into a subscriber contract with a wireless carrier, which requires an activation fee and monthly service fees. However, persons with low-income or with marginal credit ratings may be unable to afford a cellular subscriber contract. To help alleviate this problem, the FCC issued an order "Enhanced 911 Emergency Calling Use of Non-Initialized Phones (CC Docket No. 94-102/02-120)," governing wireless enhanced 911 emergency calling use of non-service initialized or unsubscribed cellular telephones, which requires wireless carriers to provide basic wireless enhanced 911 functionality for "911-only" cellular telephones, without having to enter into a subscriber contract with a wireless carrier. The FCC requires such cellular telephones to be preprogrammed with unique identity "call back" numbers or mobile identification number so emergency 911 dispatch operators can identify such 911-only cellular telephones. However, these cellular telephones are not specialized for automatic notification to 911 operators in carbon monoxide or fire emergencies.

As described above, presently available conventional carbon monoxide and combination carbon monoxide/smoke alarms are primarily used for alerting building occupants with an audible or visual alarm, and presently available integrated security systems require an intermediate central station monitoring facility, but provide neither a means for automatic and direct contact to a 911 dispatch operator (i.e, a 911 public safety answering point), nor a means for automatic wireless enhanced 911 location determination.

Conventional carbon monoxide and smoke alarms also require that evacuating building occupants or bystanders use voice-only landline or cellular telephones to contact a emergency 911 dispatch operator to report a impending carbon monoxide or fire emergency.

SUMMARY OF THE INVENTION

Therefore, in light of the foregoing disadvantages, it is a object of the present invention to provide a improved, combination carbon monoxide and carbon monoxide/smoke alarm with an integrated cellular transceiver operating in a wireless enhanced 911 location system to automatically detect carbon monoxide or smoke in the surrounding environment, to automatically initiate a 911 emergency call, to automatically determine the geographic location of such emergencies, and to automatically and directly notify emergency 911 public safety answering point operators of the location of such emergencies.

To achieve the advantages over existing carbon monoxide alarms and integrated security systems, one of the embodiments described herein comprises an improved, combination, self-contained unit that interfaces cellular transceiver circuitry and control circuitry with a carbon monoxide sensor. The cellular transceiver circuitry includes a programmed processor and memory, containing unique emergency identification information that is transmitted and processed through a wireless enhanced 911 location system directly to a 911 public safety answering point, who will summon public safety personnel to the location of the emergency. The present invention overcomes the above-mentioned shortcomings of existing single and multiple station carbon monoxide alarms by the following, which includes: allows alerted building occupants expedient evacuation, without the concern or confusion of immediately locating a telephone to call a 911 public safety answering point operator; increases carbon monoxide safety in buildings housing at-risk persons including young children the elderly, handicapped, hearing impaired, and heavy-sleeping or intoxicated persons who may be unable or have limitations in making a 911 emergency call; provides "cellular-only" households automatic and direct access to a 911 public safety answering point during carbon monoxide emergencies; provides carbon monoxide and smoke detection capabilities to building structures that are unoccupied, vacant, undergoing construction, without landline telephone service, or with no registered street address.

It is another object of the present invention to utilize the existing wireless E-911 location system infrastructure for automatically and directly relaying carbon monoxide emergency event and location information to a 911 public safety answering point operator, eliminating the need of utilizing a proprietary, or specially designed security network infrastructure, and requiring an additional intermediate central station monitoring facility to receive and retransmit emergency information to a 911 public safety answering point operator, typically required in most household security systems employing carbon monoxide or smoke detectors. This feature overcomes the shortcomings of existing integrated security systems, by relaying concise information directly to a 911 public safety answering point without the need of a commercial intermediate central station monitoring facility to retransmit the emergency call at the time the carbon monoxide or smoke is detected, reducing response time and injury to occupants and public safety personnel, and any property damage resulting from delays; provides an affordable, accessible, and effective carbon monoxide safety option for persons with low-income, marginal credit ratings, and non-homeowners.

It is still another object of the of the present invention to integrate a Assisted Global Positioning System receiver with the cellular transceiver circuitry to provide augmented wireless E-911 location determination in order to overcome the shortcomings of network-only, and GPS-only wireless enhanced 911 location systems.

It is a further object of the present invention to provide an improved, integrated multi-directional high candela strobe alarm enclosed in a specially configured housing that overcomes the limitations of existing strobe-equipped carbon monoxide alarms or combination carbon monoxide/smoke alarms.

It is still a further object of the invention to provide integrated audio receiver circuitry to receive audible alarm signals emitted from existing conventional carbon monoxide or smoke alarms within audible range.

It is still another object of the present invention to provide a portable, self-contained, carbon monoxide or combination carbon monoxide/smoke alarm configured for use in vans, recreational vehicles, travel trailers, or campers.

Although this Summary and the Description below contain many specifics, these should not be construed as limitations on the scope of the invention, but rather an exemplification of embodiments thereof. Accordingly, those skilled in the art may appreciate that this conception, upon which this disclosure is based, may be utilized as a basis for designing other devices, methods, or systems for carrying out the several purposes of the invention.

DETAILED DESCRIPTION

Prior to describing the details of the invention in its illustrative embodiments, it is understood that this invention is not limited in its application or use to the arrangement of parts and details of construction shown in the attached drawings, due to the fact that the illustrative embodiments may be incorporated in other embodiments or variations, and may be modified or implemented in other ways. Additionally, any technical terms or expressions used herein are for the purpose of describing the illustrative embodiments, and not for limiting the scope of the invention.

Figure 1:
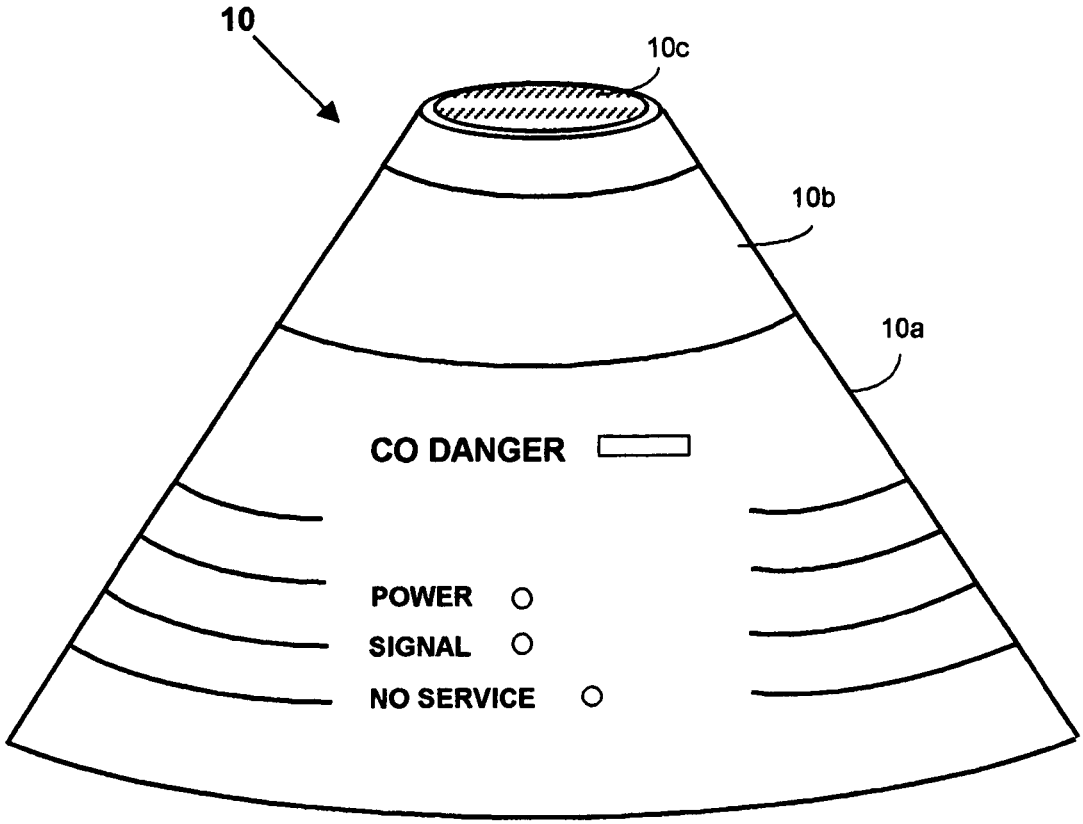
FIG. 1 is a illustration of a front perspective view of a housing for the Combination Carbon Monoxide and Wireless E-911 Location Alarm.

The housing embodiment of the Combination Carbon Monoxide and Wireless E-911 Location Alarm is illustrated as Alarm Device 10 in FIG. 1. Illustrated therein is a front perspective view of Alarm Device 10, comprising housing 10*a*, which is generally of conical configuration with a base and enclosed sides that define an interior region. The face of housing 10*a* includes a plurality of slots or vents formed to allow the passage of air, carbon monoxide, or smoke into the interior space. Next shown is window 10*b*, which is formed in the face of the housing, with a clear lens cover that allows the emission of light from the interior to the environment by multi-directional strobe alarm 42 (FIG. 2A), further described below. The face of housing 10*a* may also include a multitude of apertures or perforations in the housing face for power indicators, low power indicators, alarm indicators, alarm status indicators, and/or wireless service indicators. Alarm Device 10 preferably includes a button 10*c* (described below in FIG. 2A as alarm status/delay button 46) for a user to manually verify the operational status of power, sensor, and alarm circuitry of Alarm Device 10 during stand-by mode, or to execute a time delay function in alarm mode. It is understood that many housing shapes or designs, and any configuration of apertures, indicators, or buttons may be used to carry out the objectives of the embodiments herein described.

Figure 2A:
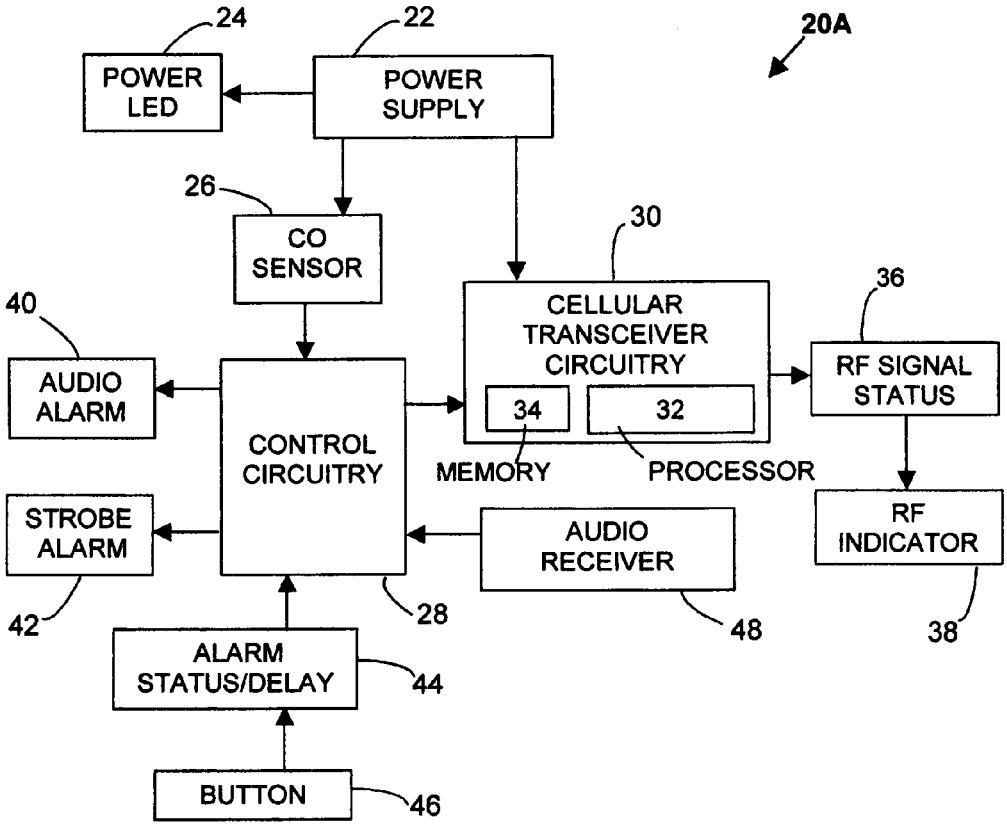
FIG. 2A is a block diagram illustrating the main embodiment of the Combination Carbon Monoxide and Wireless E-911 Location Alarm.

FIG. 2A illustrates a block diagram of Alarm Device 20A. Alarm Device 20A is a self-contained carbon monoxide alarm equipped with a cellular transceiver, which is preferably contained in the interior region of housing 10*a* (FIG. 1). The Alarm Device 20A monitors and detects the presence of carbon monoxide in the environment, alerts building occupants by audible or visual alarm signals, and automatically initiates and transmits a 911 emergency call embedded with emergency identification information over a wireless enhanced 911 (wireless E-911) location system which processes the signals to determine the geographic location of Alarm Device 20A, and routes the emergency identification and location information to a 911 public safety answering point (PSAP) to dispatch or summon public safety personnel to the location of Alarm Device 20A.

As illustrated in FIG. 2A, power supply 22 comprises AC/DC power management and transformer circuitry, which provides primary and secondary power to Alarm Device 10. In this embodiment, primary AC power is automatically converted to DC power, and stored in a rechargeable DC battery in the event AC power is interrupted. Power Indicator 24, which may be an LED, is a means for visually monitoring the status of the AC or DC power of Alarm Device 10. In addition, Power supply 12 may be configured to provide an audible signal upon low DC power. To obtain its source of AC power, Alarm Device 10 may be configured with an electrical cord, plug, and plug/outlet restraining means to be plugged into an AC outlet of the building structure. Alternatively, Alarm Device 10 may be hardwired to an AC power source. Other embodiments may include primary AC power, primary or secondary DC power, or both.

Next shown in FIG. 2A is carbon monoxide sensor 26, which may be either a self-purging, solid state sensor, electrochemical sensor, or a biomimetic sensor, or other type of carbon monoxide sensor. Carbon monoxide sensor 26 is configured to detect a predetermined threshold of carbon monoxide in the protected environment. In another embodiment (FIG. 2C, described below), ionization or photoelectric smoke sensors may be combined in Alarm Device 20A with the carbon monoxide sensor to provide additional smoke alarm capabilities.

Also illustrated in FIG. 2A is control circuitry 28, which preferably includes one or more programmed processing units, logic circuits, or microprocessors, and a memory to carry out the detection and alarm functions of Alarm Device 20A. Control circuitry 28 controls the overall operation of Alarm Device 20A, by processing input signals from carbon monoxide sensor 26 to determine dangerous conditions in the environment, and subsequently outputs alarm signals to other Alarm Device 20A alarm components. Control circuitry 28 may include programming to automatically or manually execute a self-diagnostic routine that verifies the operational status of power, sensor, and alarm circuitry elements of Alarm Device 20A.

Further illustrated in FIG. 2A and coupled to control circuitry 28 is cellular transceiver circuitry 30, which may be a cellular chipset similar in structure, design, and operation to cellular transceivers or cellular chipsets employed in cellular telephones that are configured to operate in cellular or PCS networks and wireless E-911 location systems. Cellular transceiver circuitry 30 preferably includes a programmed processor and memory. Processor 32 includes executable instructions to automatically initiate a 911 emergency call sequence, which involves embedding and transmitting emergency identification information pre-stored in memory 34. Cellular transceiver circuitry 30 may be configured to utilize wireless data transfer protocols such as SMS, CDPD, GPRS, CDMA, or other wireless data transfer or wireless air interface protocols configured to operate in cellular or PCS networks and wireless E-911 location systems. Cellular transceiver circuitry 30 may further include programming to automatically or manually execute a self-diagnostic routine that verifies the operational status of the transceiver signal, power, and other critical cellular transceiver functions.

In the embodiments (e.g., FIG. 2A, 2B, 2C, 2D) described herein, the emergency identification information that is pre-stored in memory 34 and automatically embedded and transmitted in the emergency 911 call over the wireless E-911 location system includes the cellular transceiver's device identification number, which may include the Mobile Identity Number, Electronic Serial Number, International Mobile Equipment Identity, Mobile Station Identifier, or other identity numbers consisting of sequences of characters and/or digits, which are typically used to identify a cellular or PCS device in a cellular, PCS, or wireless E-911 location system. In addition, memory 34 may include information that indicates the type of emergency (e.g. carbon monoxide or fire emergency). Other information may be combined or embedded with the emergency identification information in the 911 emergency call by the wireless E-911 location system, including location information, such as the cell site or cell sector, the RF channel, message type, routing information, or longitude and latitude coordinates or other location processing information typically generated by the wireless E-911 location system. Once routed to the PSAP, the combined emergency identification and location information will appear on the PSAP's computer display allowing the operator to dispatch and summon the appropriate public safety personnel to the location of the emergency.

In the embodiments described herein, the user may not be required to obtain a cellular carrier subscriber/service contract for Alarm Devices 20A, 20B, 20C, and 20D. In this regard, the emergency identification data pre-stored in memory 34 may include additional pre-stored information required in unsubscribed or non-service initialized 911-only cellular telephones by an FCC order entitled, "Enhanced 911 Emergency Calling Use of Non-Initialized Phones (CC Docket No. 94-102/02-120), such as the proposed consecutive number code "123-456-7890" that serves as the call back number/mobile identification number to aid PSAP's in identifying a unsubscribed device calling a PSAP for emergency assistance. Alternatively, the additional pre-stored information may consist of the Emergency Services Interconnection Forum proposed Joint Standard 036 (J-STD-036) entitled, "Enhanced Wireless 911 Phase II, which proposes the use of 911 followed by part of a wireless device's Electronic Serial Number, or International Mobile Station Equipment Identity to create a unique identification number used by a PSAP to identify unsubscribed devices. Alarm Devices 20A, 20B, 20C, and 20D may employ either the FCC's consecutive number code or J-STD-036 when operating as a unsubscribed device in a wireless E-911 location system, which may eliminate the requirement for a carrier subscriber contract.

Alarm Devices 20A, 20B, 20C, and 20D are configured to operate in cellular or PCS network infrastructures that are upgraded and configured to comply with the mandated FCC Phase I and Phase II standards governing wireless E-911 location systems being deployed by cellular or PCS carriers in any given area or region. As such, the wireless E-911 location system may include a cellular or PCS network infrastructure comprised of a plurality of cell-towers or base stations, one or more mobile switching centers, mobile positioning centers, position determination entities, Global Positioning System (GPS) satellite, and a public switched telephone network. The wireless E-911 location system allows PSAP's and public safety personnel to automatically determine the fixed geographic location of a cellular telephone or other device, or in mobile applications, track its movements during emergency calls to 911, based on various levels or accuracy depending on the type of the above-described cellular or PCS network infrastructure equipment being deployed.

For example, under the FCC Phase I wireless E-911 location system standard, the approximate location of Alarm Devices 20A, 20B, 20C, and 20D is determined by the cellular or PCS carrier providing the PSAP with Alarm Device 10's emergency identification and location information that may include cell site or cell sector numbers.

In another example, the FCC Phase II wireless E-911 location system standard allows a more precise location determination using either a network or handset-based location concept. In a Phase II network-based wireless E-911 location system, one or more cell towers or base stations and other above-described location infrastructure equipment are employed to process Alarm Devices 20A, 20B, 20C, or 20D's 911 emergency call signal and perform time difference of arrival and/or angle of arrival location measurements, then route the resulting location information (e.g., longitude, latitude, uncertainty factor) and any other associated information (e.g., cell site or cell sector numbers, or other routing information) embedded in Alarm Devices 20A, 20B, 20C, or 20D's 911 Emergency call through the carriers' network infrastructure to the PSAP.

In still another example, the FCC Phase II handset-based concept generally integrates a GPS receiver with a cellular transceiver. GPS is a popular satellite-based navigation system that provides coded satellite signals that are processed in a GPS receiver to yield the position and velocity of the receiving unit. This location concept generally requires the line-of-sight signal transmission of a plurality of GPS satellites to determine the longitude and latitude coordinates of the GPS receiver. It is important to note that GPS-only handset-based concepts may exhibit a degraded location determination under circumstances when the GPS signals are obscured, such as indoors, or in building-dense urban areas. In addition, GPS-only has an increased time-to-first-fix. Other handset-based location concepts provide supplemental location determination for GPS, including Assisted GPS (A-GPS), Differential GPS, and Wide Area Augmentation System. Utilizing A-GPS in a wireless E-911 location system is known as a "hybrid" network/handset-based location concept that provides advantages over GPS-only and network-based location concepts.

Figure 2B:
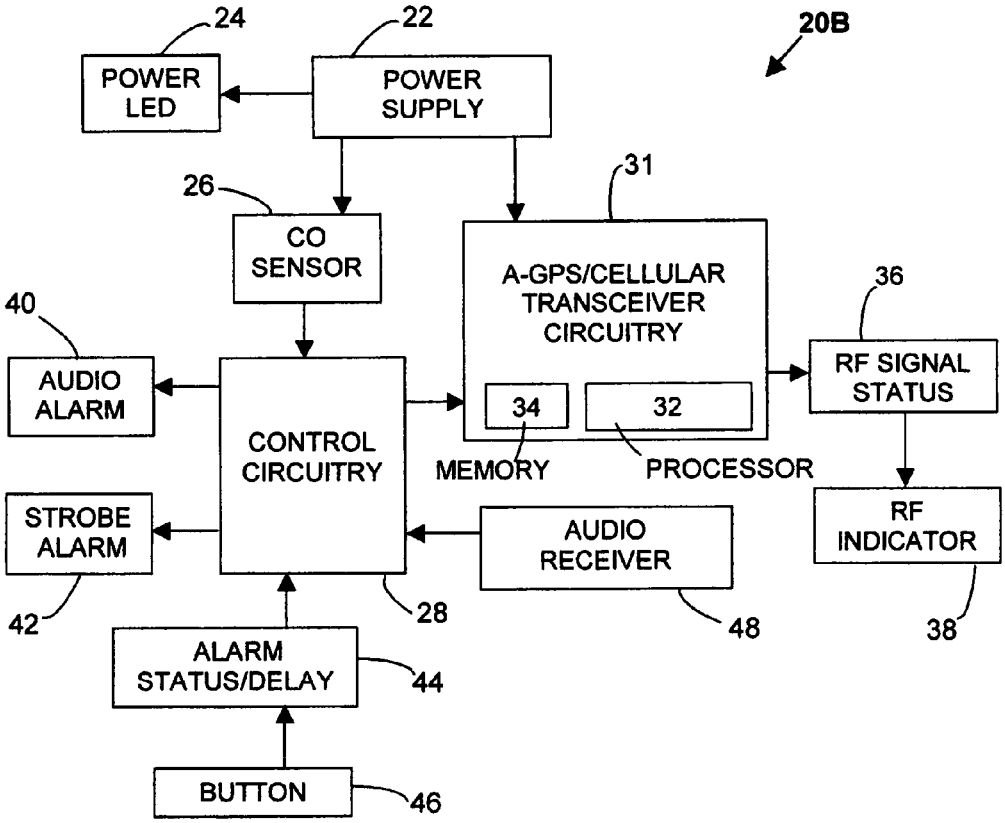
FIG. 2B is a block diagram illustrating another embodiment of the Combination Carbon Monoxide and Wireless E-911 Location Alarm.

In other embodiments (FIGS. 2B and 2D), cellular transceiver circuitry 30 may integrate a A-GPS receiver circuitry similar in structure, design and operation to A-GPS enabled cellular telephones that are configured to operate in hybrid wireless E-911 location systems. Now referring to FIG. 2B, illustrated is Alarm Device 20B, which includes A-GPS/cellular transceiver circuitry 31, which preferably includes a programmed processor and memory. Upon initiating the 911 emergency call, A-GPS/cellular transceiver circuitry 31 is configured to simultaneously collect longitude and latitude measurements from the GPS constellation and the cellular or PCS network wireless E-911 location system, then transmit the information to a A-GPS configured Position Determination Entity that is part of the wireless E-911 location system infrastructure, which processes the position location calculations. Similar to Alarm Device 20A, A-GPS/cellular transceiver circuitry 31 subsequently transmits Alarm Device 20B's emergency identification and the location information through the cellular PCS network infrastructure to a PSAP.

Now referring back to FIG. 2A, further illustrated and connected to cellular transceiver circuitry 30 is RF signal analysis circuit 36 and RF indicator 38, for measuring and visually monitoring the cellular network's signal level. RF signal analysis circuit 36 and RF indicator 38 allows the user to determine the sufficiency of the cellular network's signal level to Alarm Device 20A. As such, RF indicator 38 may be configured to illuminate upon receiving a predetermined signal level from the wireless E-911 location system.

Further illustrated and connected to control circuitry 28 is high-decibel, multi-mode audio alarm 40, which may be a piezo alarm or other high-decibel electronic horn or buzzer. In alarm mode, the audio alarm 40 emits a high-decibel sound upon receiving alarm signals from control circuitry 28 indicating a carbon monoxide emergency. In delay mode (which is initiated by alarm status/delay button 46, described below) audio alarm 40 emits a bursts of intermittent tones to indicate a temporary time delay in the transmission of the 911 emergency call signal.

Further illustrated is multi-directional strobe alarm 42, which is a high-candela, flashing light source enclosed in housing 10*a* (FIG. 1), which provides a vertical or horizontal 360-degree high-candela illumination upon receiving alarm signals from control circuitry 28. Multi-directional strobe alarm 42 provides 360-degree high-candela illumination on a vertical plane when the base of the housing is fastened to a vertical surface such as a wall, or provides 360-degree high-candela illumination on a horizontal plane when the base of the housing is fastened to a horizontal surface such as a ceiling. Alternatively, the device may provide 360-degree high-candela illumination on a horizontal plane when the base of the housing is positioned on a horizontal surface such as a table, shelf, nightstand, or other furnishings with a horizontal surface.

Next illustrated is multipurpose alarm status/delay circuit 44, which is provided to automatically or manually execute a self-diagnostic routine that verifies the operational status of power, sensor, and alarm circuitry elements of Alarm Device 20A in stand-by mode, and to suppress nuisance or inadvertent "non-emergency" 911 emergency calls in alarm mode. Alarm status/delay circuit 44 allows a user to temporarily delay the output of alarm signal from control circuitry 28 to cellular transceiver circuitry 30 for a predetermined time period by manually pressing alarm status/delay button 46 (shown FIG. 1 as 10*c*) during alarm mode if it is determined that the alarm is a non-emergency situation, and a 911 emergency call is not desired. If after a predetermined time period carbon monoxide sensor 26 no longer senses a predetermined threshold of carbon monoxide, control circuitry 28 will reset into stand-by mode. For safety purposes, the alarm delay circuit and button may include a default alarm mode beyond a predetermined number of consecutive uses.

Further illustrated in FIG. 2A, Alarm Device 20A may employ a audio signal receiver circuitry 48 to receive audio alarm output signals generated by piezo or other alarm horns of remotely located conventional carbon monoxide or smoke alarms. The audio signal receiver circuitry 48 may be tuned to discrete audio frequencies of the conventional carbon monoxide or smoke alarms (depending on brand, make, or model) to activate control circuitry 28 upon receiving a audio alarm signal. Alarm Device 20A may further include a manual "on-off" switch to activate or deactivate the audio receiver circuitry.

In another embodiment, Alarm Device 20A may include wireless interconnect transceiver circuitry and code selector. Wireless interconnect transceiver transmits and receives short-range encoded alarm activation signals between a plurality of remotely located alarm devices. The code selector includes a switch with multiple numeric code settings, which allows a user to preset a code sequence to limit the transmission of the wireless alarm signal to only other devices with the same pre-set numeric code sequence. In still another embodiment, Alarm Device 20A may employ a AC power line carrier signal transmitter/receiver means to transmit and receive alarm activation signals between remotely located alarm devices over the AC power wiring of the building where carbon monoxide or smoke detection is provided. Alternatively, Alarm Device 20A may be configured to transmit and receive alarm activation signals to and from other remotely located conventional multiple-station, interconnectable carbon monoxide or smoke alarms equipped with AC power line carrier signal transmitter/receiver means.

During normal operation of the main embodiment, Alarm Device 20A is powered by power supply 22, and in stand-by mode monitoring the protected environment for carbon monoxide. If carbon monoxide sensor 26 senses a predetermined threshold of carbon monoxide, control circuitry 28 outputs an alarm signal to multi-mode audio alarm 40, cellular transceiver circuitry 30 (or A-GPS/cellular transceiver 31, FIG. 2B), and multi-directional strobe alarm 42 for as long as the carbon monoxide level is above a predetermined threshold in the protected environment. Cellular transceiver circuitry 30 automatically initiates and transmits a 911 emergency call embedded with emergency identification information over a wireless E-911 location system which processes the signals to determine the geographic location of Alarm Device 20A, and routes the emergency identification and location information to a PSAP to dispatch or summon public safety personnel to the location of Alarm Device 20A.

Figure 2C:
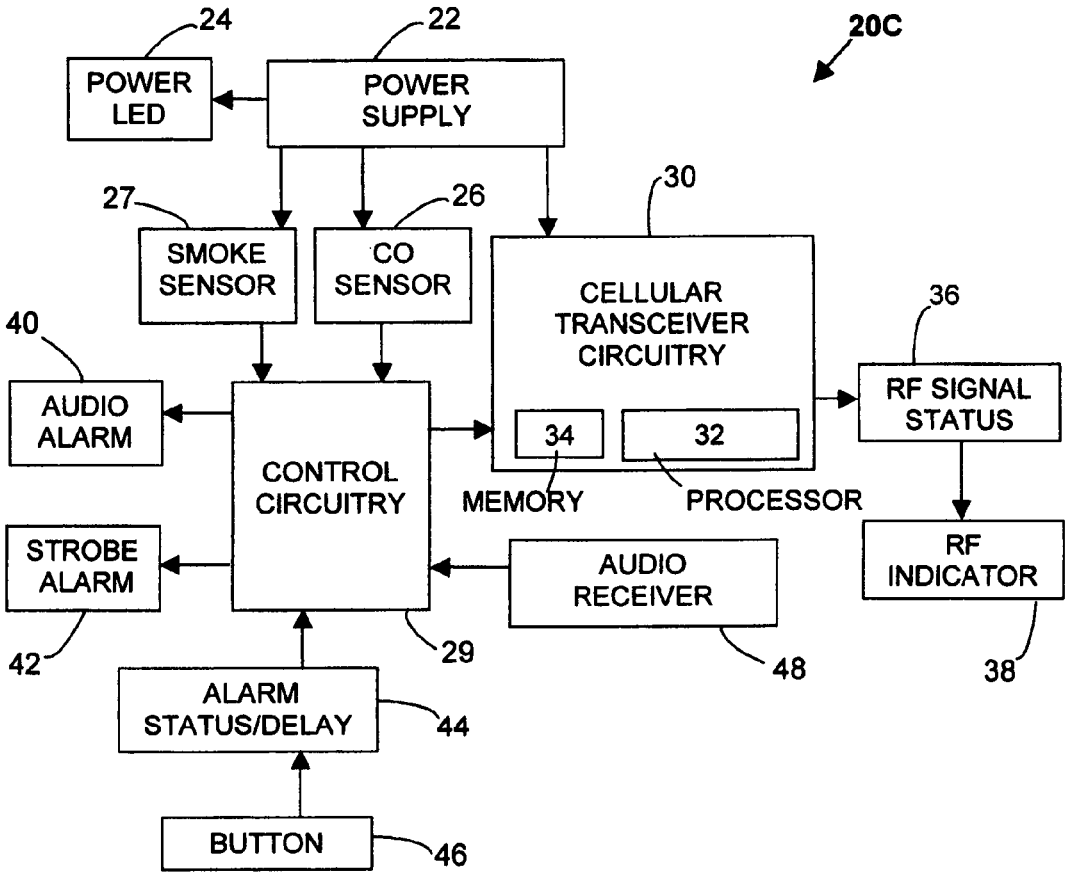
FIG. 2C is a block diagram illustrating another embodiment of the Combination Carbon Monoxide and Wireless E-911 Location Alarm.
Figure 2D:
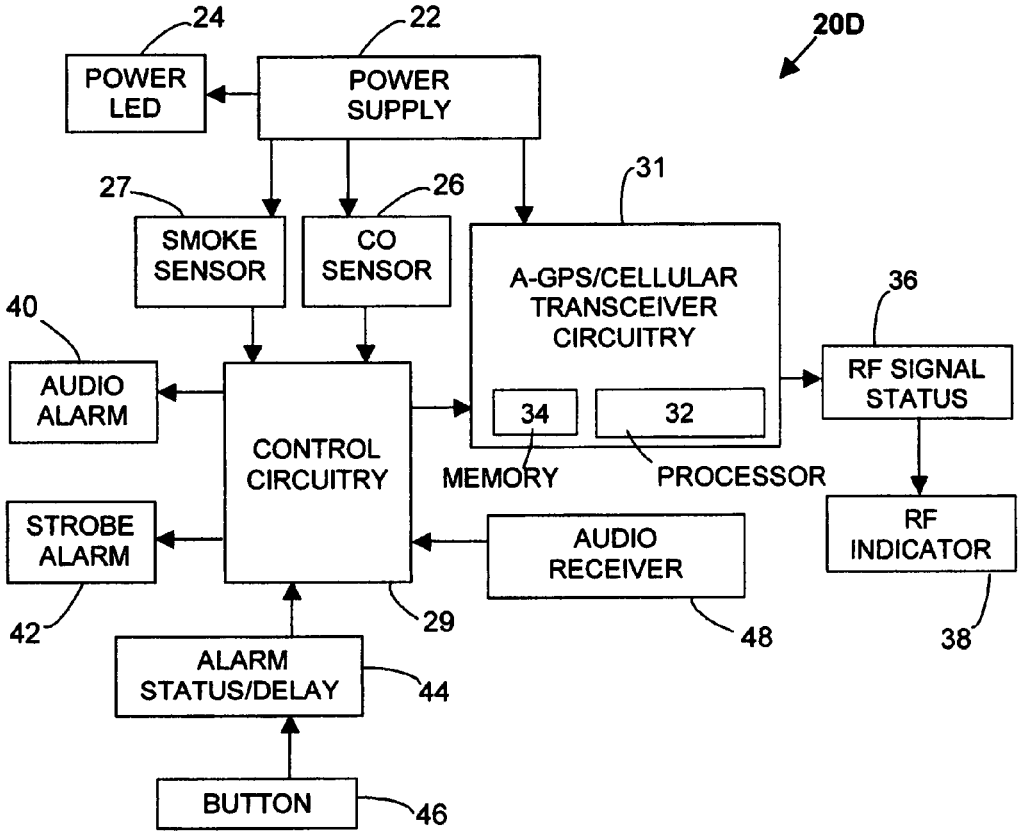
FIG. 2D is a block diagram illustrating another embodiment of the Combination Carbon Monoxide and Wireless E-911 Location Alarm.

Now referring to FIG. 2C, illustrated is Alarm Device 20C, which combines smoke sensor circuitry with carbon monoxide sensor circuitry in housing 10*a* (FIG. 1). In the embodiment described in FIG. 2C, Alarm Device 20C may include, but is not limited to, the alarm components described above in FIG. 2A or 2B, and are incorporated by reference in FIG. 2C.

As shown is FIG. 2C, smoke sensor 27 is incorporated in Alarm Device 20C with carbon monoxide sensor 26. Smoke sensor 27 may be an ionization smoke sensor or photoelectric smoke sensor and may be configured to detect a predetermined threshold of smoke in the environment.

Also illustrated in FIG. 2C and interconnected to carbon monoxide sensor 26 and smoke sensor 27 is control circuitry 29, which preferably includes one or more programmed processing units, logic circuits, or microprocessors, and a memory to carry out the detection and alarm functions of Alarm Device 20C. Control circuitry 29 controls the overall operation of Alarm Device 20C, by processing input signals from carbon monoxide sensor 26 and smoke sensor 27 to determine dangerous conditions in the environment, and subsequently outputs alarm signals indicating a fire or carbon monoxide emergency to other Alarm Device 20C alarm components. Control circuitry 29 may include programming to automatically or manually execute a self-diagnostic routine that verifies the operational status of power, sensor, and alarm circuitry elements of Alarm Device 20C.

Further illustrated in FIG. 2C and coupled to control circuitry 29 are other alarm components as described above and shown in FIG. 2A. During operation, Alarm Device 20B is powered by power supply 22, and in stand-by mode monitoring the protected environment for carbon monoxide or smoke. If carbon monoxide sensor 26 or smoke sensor 27 senses a predetermined threshold of carbon monoxide or smoke, control circuitry 29 outputs an alarm signal to multi-mode audio alarm 40, cellular transceiver circuitry 30 (or A-GPS/cellular transceiver 31, FIG. 2D), and multi-directional strobe alarm 42 for as long as the carbon monoxide or smoke level is above a predetermined threshold in the protected environment. Cellular transceiver circuitry 30 automatically initiates and transmits a 911 emergency call embedded with emergency identification information over a wireless E-911 location system which processes the signals to determine the geographic location of Alarm Device 20C, and routes the emergency identification and location information to a PSAP to dispatch or summon public safety personnel to the location of Alarm Device 20C. As described above, and as illustrated in FIG. 2D, Alarm Device 20D may provide a integrated A-GPS/cellular transceiver circuitry 31.

Figure 3:
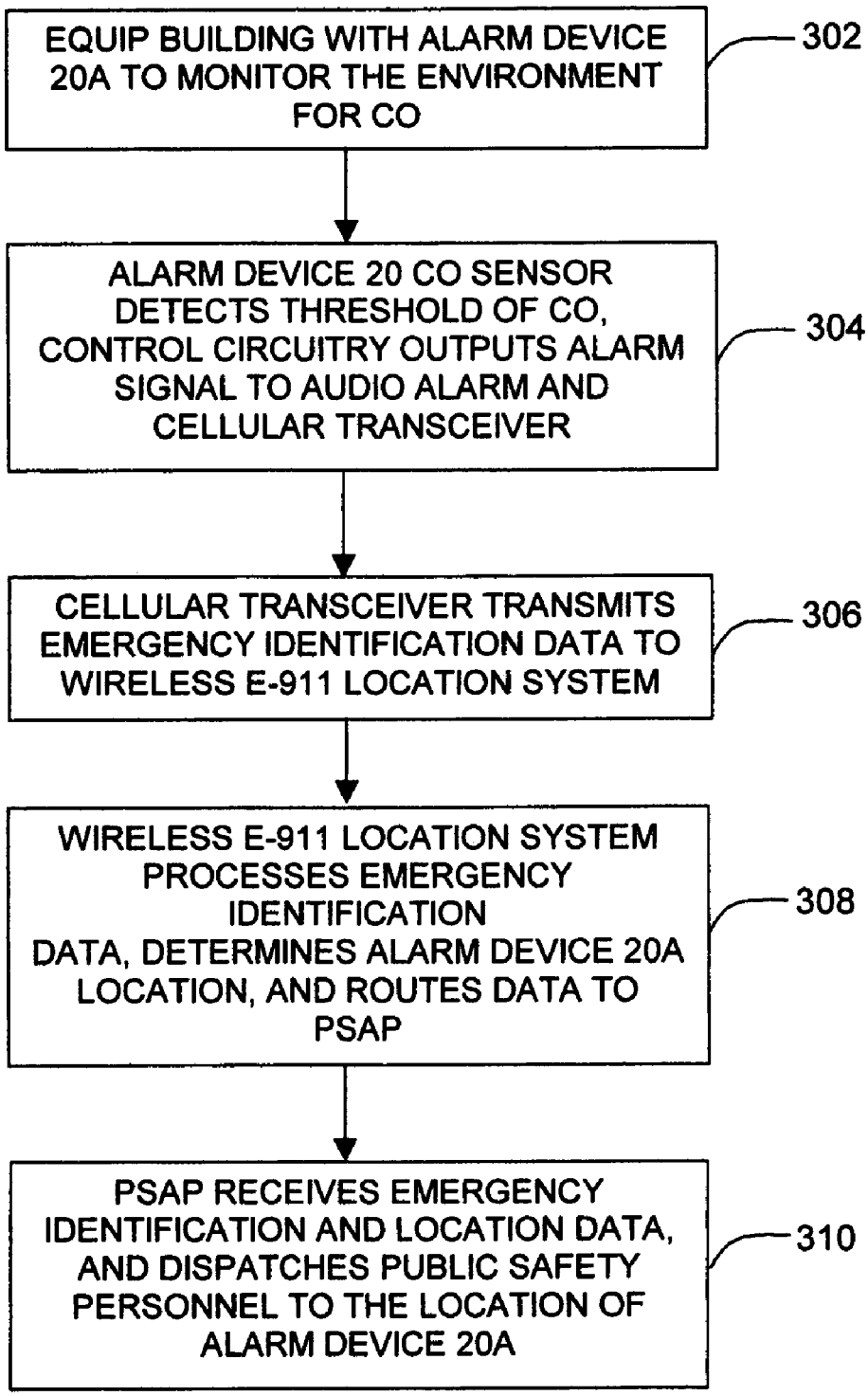
FIG. 3 is a flow chart illustrating the main method embodiment for automatically determining the geographic location of a combination carbon monoxide and wireless E-911 location alarm and automatically notifying a 911 public safety answering point to dispatch public safety personnel.

Next illustrated is FIG. 3, which is a flowchart illustrating and describing the main method embodiment of the present invention. The Combination Carbon Monoxide and Wireless E-911 Location Alarm, described above and illustrated in FIG. 2A as Alarm Device 20A, is utilized for illustrative purposes only. Other carbon monoxide alarms may be used in this or similar methods, or be similarly adapted and configured to operate in the method depicted in FIG. 3. The method described below comprises the above-described Alarm Device 20A and a cellular or PCS network modified with the aforementioned wireless E-911 location system architectures for automatically determining the geographic location of Alarm Device 20A, and automatically notifying a PSAP and public safety personnel. The steps depicted in FIG. 3 should not be limited in scope to the specifics of Alarm Device 20A, and may incorporate other embodiments. Additionally, the steps described below in FIG. 3 reference additional or alternate steps comprising further embodiments.

The first step 302 is to equip a residential or commercial building with Alarm Device 20A, which monitors the environment for the presence carbon monoxide and/or smoke. The residential or commercial building may be occupied, unoccupied, under construction, completed, or vacant. In an alternate step or embodiment, recreational vehicles, motor homes, and/or travel trailers may be equipped with a portable version of Alarm Device 20A.

In step 304, the carbon monoxide and/or smoke sensor senses a predetermined threshold of carbon monoxide and/or smoke, triggering the control circuitry, which outputs an alarm signal to the audio or visual alarm and the cellular transceiver circuitry. If the building is occupied, and if the building occupants are alerted by a audio or visual alarm, they may evacuate to safety.

Meanwhile, in step 306, the cellular transceiver circuitry initiates a 911 emergency call transmitting the pre-stored emergency identification data signals over the wireless E-911 location system. If an A-GPS receiver is integrated into Alarm Device 20A (as in FIG. 2B or 2D), the acquired A-GPS location data is transmitted along with the above mentioned emergency identification data.

In step 308, the wireless E-911 location system processes said emergency identification data signals, determining the geographic location of Alarm Device 10, and routes emergency identification and location data to a PSAP.

In step 310, a PSAP receives the emergency identification and location data, and further dispatches public safety personnel to the geographic location of Alarm Device 20A. In this step the PSAP may dispatch public safety personnel by various communication means, including but not limited to a public switched telephone network, cellular network, the internet, VHF/UHF radio, enhanced specialized mobile radio, or by SMS, CDPD, GPRS, or MMS messages. In an alternate or additional step, public safety personnel equipped with various communication and computing devices (e.g. personal computers, mobile lap-top computers, two-way radios, pagers, personal digital assistants, mobile cellular telephones), utilizing the above referenced communication means, may directly receive said processed emergency identification and location data indicating a carbon monoxide and/or a fire emergency at a specific geographic location of Alarm Device 20A.

We claim:

1. A wireless carbon monoxide alarm device, comprising:

a control circuit having a delay feature;

a sensor coupled to the control circuit, the sensor configured to generate a alarm signal upon detecting at least a threshold level of carbon monoxide;

a memory having a stored emergency identification information to indicate at least one of a carbon monoxide emergency, a fire emergency, and a delay in a 911 emergency call;

a cellular transceiver in communication with the memory and the control circuit, the cellular transceiver configured to automatically transmit the 911 emergency call comprising the emergency identification information in response to the alarm signal;

a multimode audio alarm coupled to the control circuit, wherein the multimode audio alarm is configured to at least emit a sound comprising intermittent tones to indicate the temporary delay in the transmission of the 911 emergency call;

a wireless enhanced 911 location system in communication with the cellular transceiver, wherein the wireless enhanced 911 location system is configured to receive the 911 emergency call, determine a geographic location of the wireless carbon monoxide alarm, combine the geographic location and the emergency identification information in the 911 emergency call, and route the 911 emergency call to a public safety answering point;

wherein the public safety answering point dispatches public safety personnel to the geographic location of the wireless carbon monoxide alarm.

2. The wireless carbon monoxide alarm device of claim 1, wherein the emergency identification information further comprises a device identification number comprising at least one of a electronic serial number, a mobile identity number, and a international mobile station equipment identity number.

3. The wireless carbon monoxide alarm device of claim 1, wherein the memory further comprises a non-service initialized wireless 911-only feature.

4. The wireless carbon monoxide alarm device of claim 1, further comprising:

a housing that defines an internal region, the housing enclosing the sensor, the control circuit, the cellular transceiver, the memory, and the multimode audio alarm.

5. The wireless carbon monoxide alarm device of claim 4, wherein the housing is configured in a conical shape having a base and a truncated top.

6. The wireless carbon monoxide alarm device of claim 5, further comprising:

a button mechanism attached to the truncated top of the housing, the button in communication with the control circuit, wherein the button is configured to contemporaneously emit bursts of intermittent tones and delay the output of the alarm signal from the control circuit to the cellular transceiver.

7. The wireless carbon monoxide alarm device of claim 6, wherein the housing further encloses a multi-directional strobe alarm in communication with the control circuit, the housing configured with a window to allow the multi-directional strobe alarm to emit a 360-degree illumination into the surrounding environment.

8. The wireless carbon monoxide alarm device of claim 4, wherein the cellular transceiver comprises programming configured to verify the operational status of the transceiver signal.

9. The wireless carbon monoxide alarm device of claim 8, further comprising:

a wireless service indicator in communication with the cellular transceiver and coupled to the exterior face of the housing.

10. The wireless carbon monoxide alarm device of claim 4, wherein the housing further encloses a smoke sensor coupled to the control circuit, the smoke sensor configured to sense a threshold level of smoke.

11. The wireless carbon monoxide alarm device of claim 4, wherein the housing further encloses a assisted global positioning system receiver in communication with the cellular transceiver and the wireless enhanced 911 location system.

12. The wireless carbon monoxide alarm device of claim 11, wherein the assisted global positioning system receiver is configured to determine the geographic location of the wireless carbon monoxide device in response to the alarm signal.

13. The wireless carbon monoxide alarm device of claim 4, wherein the housing further encloses a wireless interconnect transceiver in communication with the cellular transceiver.

14. A carbon monoxide alarm system, comprising:

a global positioning system receiver having an integrated cellular chipset, wherein the cellular chipset comprises a radio frequency signal analysis feature having an indicator light;

a control circuit in communication with the global positioning system receiver and the cellular chipset, an audio alarm, a visual strobe alarm, a audio signal receiver circuit, a wireless interconnection transceiver, and a 911 call delay circuit;

a sensor coupled to the control circuit, the sensor configured to generate a alarm signal in response to detecting a amount of carbon monoxide;

a power source comprising at least one of a alternating current and a direct current, coupled to the sensor, the global positioning system receiver, the cellular chipset, and the wireless interconnection transceiver;

a housing encompassing the global positioning system receiver, the cellular chipset, the control circuit, the audio alarm, the visual strobe alarm, the audio signal receiver circuit, the wireless interconnection transceiver, the sensor, the 911 call delay circuit, and the power source.

15. A method for locating a carbon monoxide emergency using a system, comprising:

at least one remotely located means for generating a audio alarm output signal having a discrete audio frequency in response to detecting at least a amount of carbon monoxide;

a control circuit coupled to a audio signal receiver circuit, wherein the control circuit is in communication with a carbon monoxide sensor, a audio alarm, a visual alarm, a delay circuit, and a power source;

a cellular transceiver having a memory, the memory comprising emergency information indicating at least a carbon monoxide emergency, the cellular transceiver in communication with the control circuit and the power source;

a wireless enhanced 911 location system in communication with the cellular transceiver and a public safety answering point;

wherein the method comprises the steps of:

generating the audio alarm output signal having a discrete audio frequency, wherein at least an amount of carbon monoxide is detected;

activating the control circuit, wherein the audio signal receiver receives the audio alarm output signal having a discrete audio frequency;

initiating a 911 emergency call, wherein the cellular transceiver automatically transmits the emergency information over the wireless enhanced 911 location system;

processing the 911 emergency call embedded with the emergency information, wherein the wireless enhanced 911 location system determines a geographic location of the carbon monoxide emergency and routes the combined emergency information and the geographic location of the carbon monoxide emergency to the public safety answering point;

dispatching public safety personnel to the location of the carbon monoxide emergency, wherein the public safety answering point sends the emergency information and the geographic location of the carbon monoxide emergency to the public safety personnel.

16. The method for locating a carbon monoxide emergency using the system of claim 15, the system further comprising:

a global positioning system in communication with the wireless enhanced 911 location system.

* * * * *